US005399242A

United States Patent [19]

Schiel

[11] Patent Number: 5,399,242

[45] Date of Patent: Mar. 21, 1995

[54] MACHINE FRAME FOR SUPPORTING DEWATERING ELEMENTS

[75] Inventor: Christian Schiel, Heidenheim, Germany

[73] Assignee: J.M. Voith GmbH, Heidenheim, Germany

[21] Appl. No.: 57,330

[22] Filed: May 4, 1993

[30] Foreign Application Priority Data

May 12, 1992 [DE] Germany ..... 9206152 U

[51] Int. Cl.[6] ..... D21F 3/00; D21G 9/00

[52] U.S. Cl. ..... 162/272; 162/273; 162/358.1

[58] Field of Search ..... 162/272, 273, 274, 358.1, 162/200; 100/153, 176

[56] References Cited

U.S. PATENT DOCUMENTS

| | | | |
|---|---|---|---|
| 3,547,776 | 12/1970 | Curtis | 162/274 |
| 4,140,575 | 2/1979 | Wenzl | 162/273 |
| 4,657,634 | 4/1987 | Autio | 162/273 |
| 4,861,431 | 8/1989 | Tormanen | 162/273 |
| 4,875,975 | 10/1989 | Schiel | 162/273 |
| 5,207,872 | 5/1993 | Jansson | 162/272 |

FOREIGN PATENT DOCUMENTS

| | | |
|---|---|---|
| 0224461 | 3/1987 | European Pat. Off. . |
| 0287543 | 10/1988 | European Pat. Off. . |
| 3242721 | 5/1984 | Germany . |
| 911258 U | 1/1992 | Germany . |

*Primary Examiner*—Karen M. Hastings
*Attorney, Agent, or Firm*—Ostrolenk, Faber, Gerb & Soffen

[57] ABSTRACT

A machine frame for supporting at least one dewatering element (a roll, suction box or the like) over which an endless belt (a wire or felt) may travel upon operation of a paper manufacturing machine, wherein:

a) the dewatering element (10) has an operator-side end and a drive-side end;

b) a beam (11) which extends substantially parallel to the dewatering element (10) is connected in torsionally rigid manner;

b1) to a first frame part (12) for supporting the drive-side end of the dewatering element (10) and which rests in tilt-proof manner on a foundation (9);

b2) and to a second frame part (13) for supporting the operator-side end of the dewatering element (10) and which rests on the foundation (9) via removable intermediate pieces (14); and c) an extension (15) of the beam (11) extends beyond the operator-side frame part (13), the outer end of the extension (16) being adapted to rest on the foundation (9), the improvement wherein:

d) the beam (11) is a single beam arranged laterally alongside of the dewatering element (10); and e) the beam has a cross-section having a height (h) which is at least twice its width (b).

26 Claims, 2 Drawing Sheets

MACHINE FRAME FOR SUPPORTING DEWATERING ELEMENTS

BACKGROUND OF THE INVENTION

1. Field of the Invention

The present invention relates to a machine frame for supporting at least one dewatering element over which an endless belt travels during operation of a papermaking machine.

2. Description of the Related Art

Machine frames of this type are present, in particular, in paper manufacturing machines. The dewatering element may be a roll, for instance a dewatering suction roll or a press roll, or else, for instance, a stationary suction box. In each case, an endless belt, for instance a wire belt or a felt belt, travels upon operation over the dewatering element. The invention can therefore be used in particular in the wire end or the press end of a papermaking machine.

A prior art machine frame of background interest has the following features:

a) the dewatering element has an operator-side end and a drive-side end;

b) a beam which extends substantially parallel to the dewatering element is connected in torsionally rigid manner;

b1) to a first frame part for supporting the drive-side end of the dewatering element which rests in tilt-proof manner on a foundation;

b2) and to a second frame part for supporting the operator-side end of the dewatering element which rests on the foundation via removable intermediate pieces; and c) an extension of the beam extends beyond the operator-side frame part, the outer end of the extension being adapted to rest on the foundation.

These features are known from Federal Republic of Germany OS 32 42 721 (File P 3983). This publication concerns a roll press having two press rolls which form a press nip with each other. The ends of the lower press roll rest on lower frame parts. In the same way, the upper press roll rests on upper frame parts. On the drive-side end, the frame parts are rigidly connected with each other to form a frame. On the other hand, on the operator-side end, the frame parts are connected to each other by tension elements which serve to transmit the pressing force from the upper frame part to the lower frame part. The tension elements can be loosened in order, for instance, to replace the endless belt which travels around the lower press roll with a new felt belt. In addition, the following features are provided for this purpose: The operator-side lower frame part, in normal condition of operation, rests on the foundation via two removable intermediate pieces. A beam (59) connects this frame part to the drive-side frame. On the outer side of the drive-side lower frame part, there is provided an auxiliary support (58) which forms an extension of said beam and which can also be supported on the foundation, for instance via a removable intermediate piece (60). Furthermore, two beams (29) are provided in order to connect the upper operator-side frame part with the drive-side frame. These beams are fastened in torsionally rigid manner to the frame parts.

One disadvantage of this known machine frame is its relatively large size. This results, among other things, from the fact that the lower beam (58) is arranged below the upper press roll and furthermore from the fact that two upper beams (29) are necessary and that they are arranged above the upper press roll. Finally, the transmission of the pressing force from the upper frame part to the lower frame part requires a relatively heavy construction.

Federal Republic of Germany Utility Model 91 12 587 (File P 4876) discloses another roll press in which the bearing brackets of the two press rolls are connected directly by means of detachable tie bars which serve for the transmission of the pressing force. This manner of construction may cause the machine frame to be acted on only by the weight of the press rolls themselves but not by the pressing force. Therefore, the machine frame may possibly be made substantially lighter. However, no further details are disclosed in this German Utility Model.

The disclosures of the above-mentioned references are expressly incorporated by reference herein.

SUMMARY OF THE INVENTION

The primary object of the present invention is to develop an improved machine frame having the general features discussed above, in such a manner that its size is substantially reduced.

Another object is that, nevertheless, the dewatering element (for instance a roll, suction box or the like) should be accessible from one side over its entire length.

A further object is to ensure that the machine frame is acted on only by the weight of the dewatering element itself, and possibly by the weight of belt guide rolls, but not by operating forces, for instance a pressing force.

This object is achieved by a machine frame wherein the beam is arranged laterally alongside of the dewatering element; and the beam has a cross-section having a height (h) which is at least twice its width (b).

In the simplest case, the machine frame of the invention has, on both the operator end of the dewatering element and the drive end, only one lower frame part at each end, these two lower frame parts being connected to each other by a single beam. That beam is preferably of rectangular cross section, which is arranged vertically.

It is of great importance that this beam be in itself torsionally rigid to the greatest extent possible, and furthermore be connected in torsionally rigid manner to the frame parts (as known per se).

In the same way as previously known, therefore, the dewatering element and the beam extend substantially parallel to each other transversely through the machine. Because of the above-mentioned inventive features, however, the beam can now be arranged laterally alongside the dewatering element. In this way, a considerable saving in space is obtained as compared with what was previously the case. In particular, the structural height is considerably reduced. Due to the fact that only a single beam is present, the dewatering element is easily accessible over its entire length (for instance, for cleaning or inspection).

In the simplest case described above, the introduction of an endless belt is effected in two steps: The belt is first of all pulled over the extension of the beam whereupon the end of the extension is supported on the foundation by, for instance, a lifting device. The intermediate pieces present below the operator-side frame part can now be removed, whereupon the belt is pulled completely over the dewatering element. For this, it is important for the drive-side frame part to rest, as known, in tilt-proof manner on the foundation and therefore, for instance, to stand on two legs. Temporarily, therefore, the entire machine frame stands only on these two legs and on said lift device, which forms a third leg. In this connection, the beam is stressed in torsion, particularly under the weight of the dewatering element. In normal condition of operation, the machine frame, on the other hand, stands on said two legs and on the two intermediate pieces, and therefore on a total of four legs.

If the endless belt is to remain unreefed or only slightly reefed upon being pulled over the extension of the beam, the extension must be of suitable length. If such an arrangement is disturbing in normal operation, then rather than the extension being rigidly connected to the beam, it may be connected telescopically to it so that it can be moved in and out.

In certain cases, there is present, above the dewatering element, an additional dewatering element over which an additional endless belt (wire or felt) travels during operation. Therefore, according to another aspect of the invention, in order for this additional belt to also be replaced from time to time, there is provided, laterally alongside the additional dewatering element, a second beam which, in its turn, is in itself torsionally rigid and is connected in torsionally rigid manner with an upper operator-side (fourth) frame part and an upper drive-side (third) frame part.

A particular simplification is obtained in this case, in accordance with a further concept of the invention, in the manner in which the two beams are rigidly connected to each other at their drive ends, where they together form a preferably single-piece, C-shaped structural part. In normal operating condition, the operator-side end of the additional beam rests via a removable intermediate piece on the first beam which is below it.

Other features and advantages of the present invention will become apparent from the following description of embodiments of the invention which refers to the accompanying drawings.

DETAILED DESCRIPTION OF EMBODIMENTS OF THE INVENTION

Figure 1:
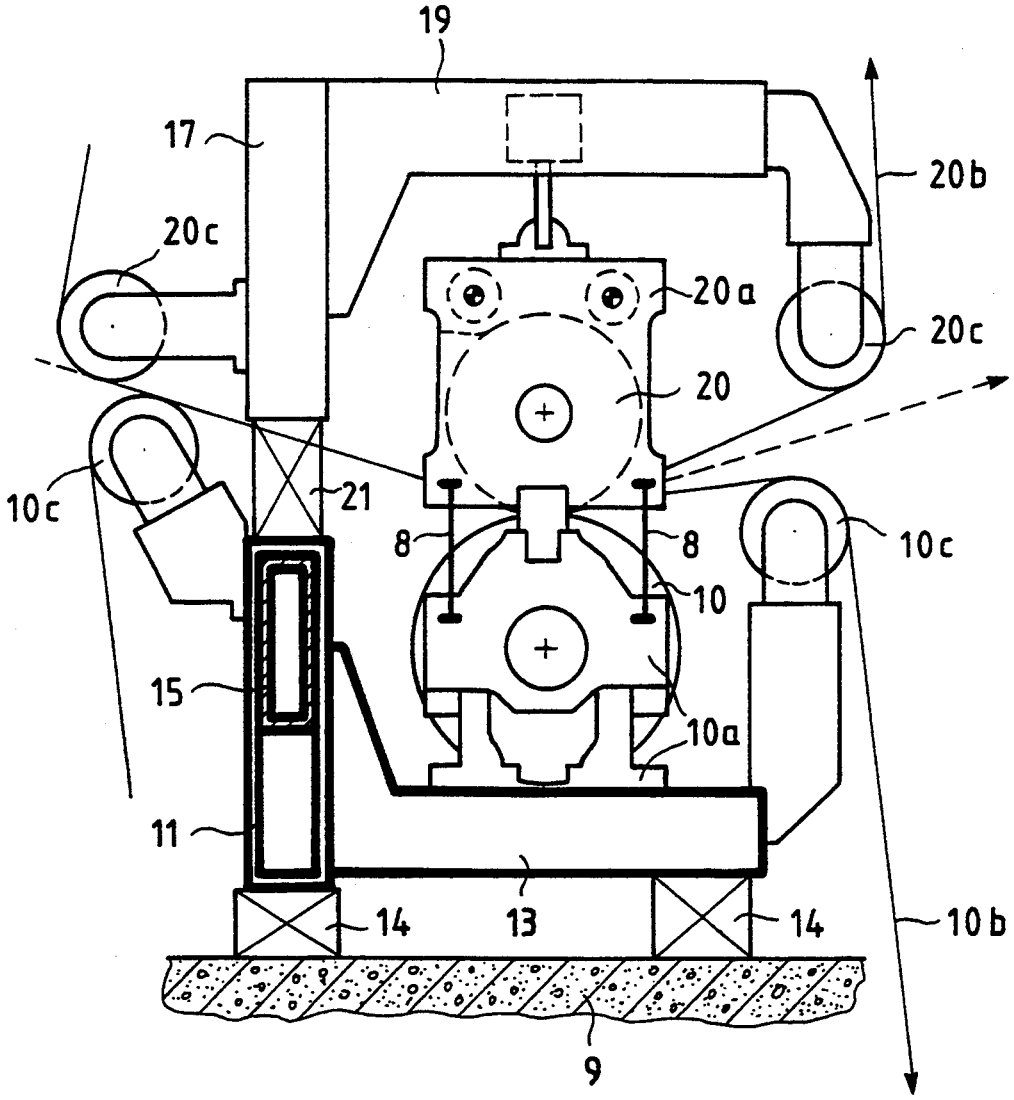
FIG. 1 is a schematic side elevational view of a machine frame for a two-roll press.
Figure 2:
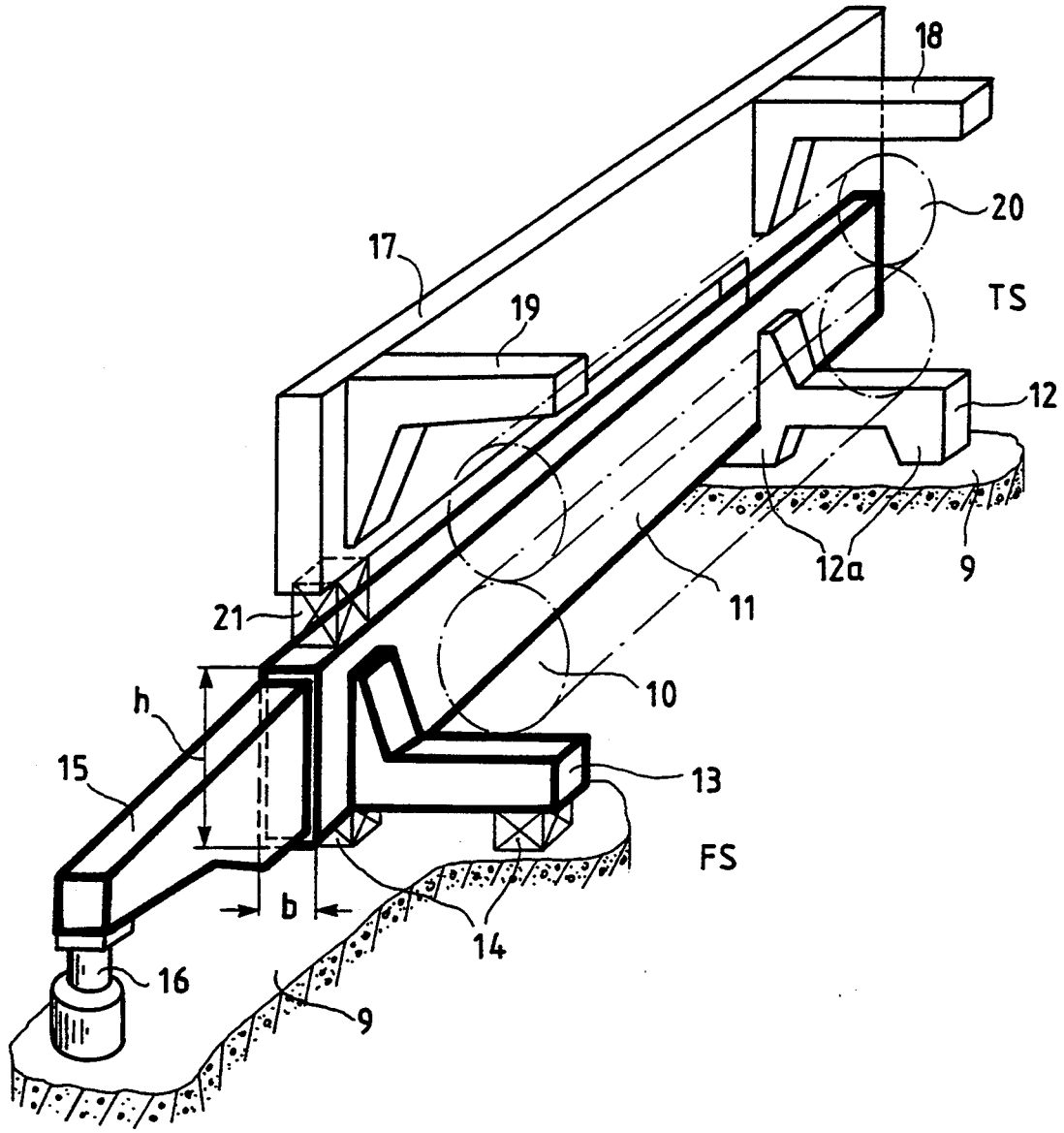
FIG. 2 is a schematic perspective view of the machine frame of FIG. 1.

In both figures, a lower press roll is designated 10 and an upper press roll is designated 20. In accordance with FIG. 1, the operator-side ends of the two press rolls rest in bearing brackets 10*a* and 20*a* respectively. The lower bearing bracket 10*a* is arranged directly on an operator-side second frame part 13, while the upper bearing bracket 20*a* is arranged, on the other hand, on the lower bearing bracket 10*a*. An inner pressing device (not shown) produces the desired pressing pressure in the press nip between the two rolls 10*a* and 20*a*. For transmitting the pressing force from one bearing bracket 10*a* or 20*a* to the other, detachable tie rods 8 are provided. A similar arrangement of bearing brackets which rest on a drive-side first frame part 12 (FIG. 2) is provided at the drive-side end of the rolls 10 and 20. In FIG. 2 only the rolls 10 and 12 have been diagrammatically indicated; the bearing brackets have been omitted in order not to clutter the drawing.

In the simplest case, only a single endless belt 10*b* is present, traveling around the lower press roll 10 and furthermore over guide rolls 10*c*, which are supported on the machine frame. In this case, the machine frame comprises, in addition to the aforementioned first and second frame parts 12 and 13, only a single beam 11 which extends parallel to the rolls from the operator-side FS to the drive side TS. This beam 11 is torsionally rigid in itself and is furthermore connected in torsionally rigid manner to the frame parts 12 and 13. Beam 11 is arranged laterally alongside the lower press roll 10. On its operator-side end, the beam 11 has an extension 15, which may be rigidly connected to the beam 11. The extension 15 may also be connected telescopically to the beam 11, i.e., the extension 15 can be introduced into the inside of the beam 11.

The drive-side frame part 12 rests, for instance with the aid of two legs 12*a*, in non-tiltable manner on a foundation 9. The operator-side frame part 13, on the other hand, rests on the foundation 9 via two removable intermediate pieces 14. The outer end of the extension 15 can be supported temporarily on the foundation 9 by means of a lifting device 16 so that the intermediate pieces 14 can be removed.

The cross-section of the beam 11 has a height h which is larger than its width b. It is, for instance, rectangular, having a height h which is at least two times (and preferably 3–8 times) the width b. Thereby, beam 11 and press roll 10 can be arranged side by side in a space-saving manner; beam 17 nevertheless having the required torsional rigidity.

According to another aspect of the invention, if a second endless felt belt 20*b* travels around the upper press roll 20, then upper third and fourth frame parts 18 and 19 are provided from which the upper press roll 20 can be temporarily suspended and on which guide rolls 20*c* are supported. The third and fourth frame parts 18 and 19 are connected in torsionally rigid manner to a second beam 17, which is arranged above the first-mentioned beam 11, laterally alongside the upper press roll 20.

On their drive-side ends, the two beams 11 and 17 are rigidly connected to each other so that they form a C-shaped structural part, the closed side of the C-shape being at the drive-side end. The operator-side ends are spaced apart to form the open side of the C-shape. Between the operator-side ends, a removable intermediate piece 21 is provided.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a machine frame in combination with and for supporting at least one rotatable dewatering element over which an endless belt may travel during operation of a paper machine, having the following features:

a) a first rotatable dewatering element having an operator-side end and a drive-side end;

b) a lower beam which extends substantially parallel to the first dewatering element is connected in torsionally rigid manner:

b1) to a first frame part for supporting the drive-side end of the first dewatering element which rests in tilt-proof manner on a foundation;

b2) and to a second frame part for supporting the operator-side end of the first dewatering element which rests on the foundation via removable intermediate pieces; and c) an extension of the lower beam extends beyond the operator-side frame part, the outer end of the extension being adapted to rest on the foundation, the improvement wherein:

d) the lower beam is a single beam arranged laterally alongside of the first dewatering element;

e) the lower beam has a cross-section having a height (h) which is at least twice its width (b); and, f) the first and second frame parts are connected in the torsionally rigid manner only by the single lower beam.

2. A machine frame according to claim 1, wherein the height (h) is about 3 to 8 times the width (b).

3. A machine frame according to claim 1, wherein the extension is connected in telescopically extendable and retractable manner to the single lower beam.

4. A machine frame according to claim 1, further comprising a single upper beam which also extends parallel to the first dewatering element, the single upper beam being arranged above the single lower beam and being a sole torsionally rigid connection between a pair of upper frame parts for supporting a second rotatable dewatering element which is arranged laterally alongside the single upper beam.

5. A machine frame according to claim 4, wherein the operator-side end of the single upper beam rests on the single lower beam via a removable intermediate piece.

6. A machine frame according to claim 4, wherein the lower and upper beams are rigidly connected to each other at their drive-side ends so as to form a C-shaped structural part.

7. A machine frame according to claim 6, wherein the operator-side end of the single upper beam rests on the single lower beam via a removable intermediate piece.

8. A machine frame according to claim 4, wherein the first and second dewatering elements are first and second rolls which form a press nip and are mounted in respective first and second bearing brackets which are connected directly to each other by tie elements.

9. A machine frame according to claim 8, wherein the first and second bearing brackets are connected respectively to the lower and upper pairs of frame parts.

10. A machine frame according to claim 1, wherein at least one horizontal plane passes through both the single lower beam and the first dewatering element.

11. A machine frame according to claim 1, wherein the single lower beam and the first dewatering element are arranged side-by-side at substantially the same height above the foundation.

12. A machine frame according to claim 1, wherein the first frame part has integral legs for resting on the foundation in a tilt-proof manner.

13. A machine frame according to claim 12, wherein the single lower beam is pivotable about the legs by a lifting device disposed under the extension, for lifting the second frame part off of the removable intermediate pieces.

14. A machine frame according to claim 13, wherein the lifting device is disposed under the extension for selectively lifting the extension with respect to the foundation.

15. A machine frame in combination with and for supporting at least one rotatable dewatering element having an operator-side end and a drive-side end, over which an endless belt may travel during operation of a paper machine, comprising:

a single lower beam which extends substantially parallel to a first rotatable dewatering element;

the single lower beam being a sole torsionally rigid connection between a first frame part for supporting the drive-side end of the first dewatering element, which rests in tilt-proof manner on a foundation, and a second frame part for supporting the operator-side end of the first dewatering element which rests on the foundation via a support;

an extension of the single lower beam being extended beyond the operator-side frame part, the outer end of the extension being adapted to rest on the foundation, the single lower beam being arranged laterally alongside of the first dewatering element; and the single lower beam having a cross-sectional shape such that the height (h) of the cross-section of the single lower beam is at least twice its width (b).

16. A machine frame according to claim 15, wherein the height (h) is about 3 to 8 times the width (b).

17. A machine frame according to claim 15, wherein the extension is connected in telescopically extendable and retractable manner to the single lower beam.

18. A machine frame according to claim 15, further comprising a single upper beam which also extends parallel to the first dewatering element, the single upper beam being arranged above the single lower beam and being a sole torsionally rigid connection between a pair of upper frame parts for supporting a second rotatable dewatering element which is arranged laterally alongside the single upper beam.

19. A machine frame according to claim 18, wherein the operator-side end of the single upper beam rests on the single lower beam via a removable intermediate piece.

20. A machine frame according to claim 18, wherein the lower and upper beams are rigidly connected to each other at their drive-side ends so as to form a C-shaped structural part.

21. A machine frame according to claim 20, wherein the operator-side end of the upper beam rests on the lower beam via a removable intermediate piece.

22. A machine frame according to claim 15, wherein the first frame part has integral legs for resting on the foundation in a tilt-proof manner.

23. A machine frame according to claim 22, wherein the single lower beam is pivotable about the legs by a lifting device disposed under the extension, for lifting the second frame part off of the support.

24. A machine frame according to claim 23, wherein the lifting device is disposed under the extension for selectively lifting the extension with respect to the foundation.

25. A machine frame according to claim 15, wherein at least one horizontal plane passes through both the single lower beam and the first dewatering element.

26. A machine frame according to claim 15, wherein the single lower beam and the first dewatering element are arranged side-by-side at substantially the same height above the foundation.

* * * * *